United States Patent [19]

Ioannesian

[11] 3,989,409

[45] Nov. 2, 1976

[54] TURBODRILL

[76] Inventor: Rolen Arsenievich Ioannesian, Naberezhnaya Tarasa Shevchenko, 1/2, kv. 49, Moscow, U.S.S.R.

[22] Filed: July 14, 1975

[21] Appl. No.: 595,681

[52] U.S. Cl. ..... 415/107; 415/502; 64/23; 175/107

[51] Int. Cl.[2] ..... F01D 3/00; F01D 25/18

[58] Field of Search ..... 415/107, 502; 64/23, 64/1 R; 175/107, 320, 321

[56] References Cited

UNITED STATES PATENTS

| | | | |
|---|---|---|---|
| 2,197,019 | 4/1940 | Monroe | 64/23 |
| 2,592,519 | 4/1952 | Postlewaite | 415/107 |
| 2,990,895 | 7/1961 | Works et al. | 64/23 |
| 3,039,735 | 6/1962 | Tiraspolsky et al. | 415/502 |
| 3,054,595 | 9/1962 | Kaufmann | 415/107 |
| 3,058,510 | 10/1962 | Tiraspolsky et al. | 415/107 |
| 3,122,902 | 3/1964 | Blair et al. | 64/23 |
| 3,149,685 | 9/1964 | Mitchell et al. | 175/107 |
| 3,447,340 | 6/1969 | Garrett | 64/23 |
| 3,858,669 | 1/1975 | Jeter | 64/23 |
| 3,871,193 | 3/1975 | Young | 64/23 |

*Primary Examiner*—C. J. Husar
*Attorney, Agent, or Firm*—Haseltine, Lake & Waters

[57] ABSTRACT

A turbodrill whose body accommodates a thrust bearing taking the reaction of the bottom hole, said bearing carrying a shaft built up of separate consecutively-connected sections and mounting the turbine rotors which create a torque and a hydraulic load and transmit them to the shaft wherein, according to the invention, there is an additional thrust bearing installed on the shaft between the main thrust bearing and the turbine rotors and taking the hydraulic load and a mechanism installed on the shaft between said thrust bearings and intended to transmit torque from one shaft section to the other and capable of elastic deformation owing to which it relieves the additional thrust bearing from the hydraulic load and transmits the latter to the thrust bearing which takes the reaction of the bottom hole.

The turbodrill according to the invention makes it possible to use the thrust bearing taking the reaction of the bottom hole until said bearing is completely worn down.

5 Claims, 5 Drawing Figures

TURBODRILL

The present invention relates to turbodrills. The turbodrill according to the present invention will be used most successfully for drilling deep oil and gas wells, employing both roller and diamond bits.

Besides, the present invention will find application in directional cluster drilling of oil and gas wells.

Known in the previous art is a turbodrill whose body accommodates a shaft installed on a thrust bearing which takes the reaction of the bottom hole, said shaft being built up of a number of consecutively-connected sections and carrying the turbine rotors which create a torque and hydraulic load and transmit them to the turbodrill shaft.

In the process of drilling the turbine of the turbodrill utilizes a certain pressure drop whose magnitude depends on the amount of the drilling fluid pumped through the turbine.

This pressure drop creates a hydraulic load on the turbodrill shaft, said load being taken by the thrust bearing. The function of this thrust bearing is to fix the position of the turbine rotors with respect to its stators.

As a general rule, the turbine rotors are set to a position on which the axial clearance between the upper face of the rotor and the lower face of the stator would be equal to that between the lower face of the rotor and the upper face of the stator. Such a position of the rotors relative to the stators is referred to as "middle". The permissible deviation from the middle position should not exceed 5–6 mm.

Said position of the rotors relative to the stators is fixed by the thrust bearing.

As the turbodrill operates in an abrasive liquid, and the turbodrill shaft is subjected to a hydraulic load this leads to a gradual wear of balls and races that constitute a thrust bearing, and this bearing begins to play.

As this takes place the turbine rotors shift from the previously set middle position. As soon as the bearing play exceeds 5-6 mm range, the faces of the rotors and stators will come in contact and the resultant friction will lead to wear of the turbine.

The wear rate of the bearing or, in other words, development of its play at a preset rotational speed will depend on the axial load acting on the shaft.

In the course of drilling the load applied to the bit will be constituted by the weight of the drilling string and will be transmitted to the bit via the turbodrill body, spindle body, thrust bearing and, farther, via the lower end of the spindle shaft directly to the bit.

At the same time the thrust bearing is subjected to the reaction of the bottom hole directed from underneath upward and being equal to the load on the bit imposed by the drilling string and acting down from above.

Owing to the fact that the development of the thrust bearing play has a certain influence on the position of the rotors relative to the stators, the permissible bearing play is limited by the possibility of contact between the faces of the rotors and stators resulting in the wear of the turbine.

Besides, the turbodrill overall life is thus limited by the amount of axial clearance between the turbine rotors and stators rather than by the total wear of the bearing.

The main object of the present invention is to provide a turbodrill wherein the wear of the bearing, i.e. thrust bearing taking the reaction of the bottom hole would exert no influence on the position of rotors relative to the stators and would, therefore, rule out the contact between the faces of the rotors and stators.

Another object of the invention is to provide a turbodrill which would allow the bearing to be used until it becomes completely worn down.

These and other objects are accomplished by providing a turbodrill whose body accommodates a thrust bearing taking the reaction of the bottom hole and carrying a shaft which is built up of separate consecutively interconnected sections and which mounts the turbine rotors, the latter creating a torque and a hydraulic load and transmitting them to the shaft wherein, according to the invention, the shaft carries an additional thrust bearing installed between the main thrust bearing and the turbine rotors and taking the hydraulic load and there is a mechanism installed between said thrust bearings, designed to transmit torque from one shaft section to the other and being capable of elastic deformation which allows said shaft to relieve the additional thrust bearing from the hydraulic load and to transmit said load to the main thrust bearing which takes the reaction of the bottom hole.

Introduction into the turbodrill according to the invention of two independent thrust bearings instead of one for taking the hydraulic shaft load by one bearing and the reaction of the bottom hole by the other ensures a longer life of the thrust bearing taking the reaction of the bottom hole since the wear of this bearing or, in other words, the fact that it plays in the presence of the other bearing bears no influence on the position of the turbine rotor relative to its stator and, consequently, ensures a complete utilization of the bearing life which extends the inter-repair life of the turbodrill.

The service life of the additional thrust bearing which determines the position of the turbine rotor relative to its stator is prolonged by relieving it as much as possible from the hydraulic load acting on the turbodrill shaft.

With this purpose in view, the built-up shaft of the turbodrill is provided with a mechanism installed between the first and second thrust bearing; said mechanism transmits torque from one section of the built-up shaft to the other and is capable of elastic deformation which allows said mechanism to relieve the additional thrust bearing from the hydraulic load and transmit the latter to the thrust bearing taking the reaction of the bottom hole.

This relieving of the additional thrust bearing increases radically its service life.

The increased life of the thrust bearings extends considerably the turbodrill overhaul life.

The mechanism capable of elastic deformation is expedient to be made in the form of a flexible element one end of which is secured rigidly to that section of the built-up shaft which carries the additional thrust bearing while the other end is rigidly secured to the end of the shaft carrying the thrust bearing which takes the reaction of the bottom hole.

The heavier the load, the greater will be the wear of the bearing. The lighter the load, the smaller the bearing wear. Obviously, at a zero load acting on the shaft, the wear of the bearing will be at a minimum.

The axial load of the upper bearing is brought practically to zero by pressing it from underneath by a flexible element. Compression of the flexible element creates a force acting upward from underneath and relieving the upper thrust bearing.

If the compression force of the flexible element acting upward from underneath is equal to the hydraulic load acting from above downward, the upper thrust bearing which determines the position of the rotors relative to the stators will actually be completely relieved and its life will reach a maximum.

Besides, the lower bearing will be subjected to the force of compression of the flexible element which will relieve partly the lower bearing from the reaction of the bottom hole.

It should be noted that the wear of the lower bearing in the present invention exerts no influence on the position of the stators relative to the rotors and that it may play within much greater (by 5–6 times) range than the upper bearing.

This, in turn, ensures a long life of the lower thrust bearing.

Hence, the weak point of the current turbodrills, i.e. their thrust bearing, is placed in the present invention in new operating conditions, increasing sharply the turbodrill overhaul life which cuts down considerably the operational expenses.

Besides, one more circumstance is worthy of note.

The flexible element in the turbodrill spindle functions to some extent as a shock absorber, particularly when the bearings begin to play.

The provision of the flexible element improves substantially the operation of the bits in hard rocks, increases the penetration rate and the bit footage per run.

The most practicable method is to make the flexible element in the form of a coil spring.

The turbodrill spindle will be made more compact if the flexible element is made in the form of a bellows.

To increase the service life of the flexible element by relieving it from the transmission of torque it is quite expedient that the mechanism capable of elastic deformation should comprise a compression spring installed between the adjacent sections of the built-up shaft which carry the additional bearing and the bearing taking the reaction of the bottom hole, and a coupling installed between said shaft sections with a provision for axial motion for creating an elastic compressive deformation of the spring and for transmitting torque from one of said shaft sections to the other.

Another interesting feature of the present invention lies in the possibility of using said turbodrill for directional drilling since the provision of the flexible element transmitting torque makes it possible to have a curved turbodrill axle which is necessary for creating a force on the bit, acting square with its axis and ensuring the required curvature of the bore hole in the required direction.

Now the present invention will be described in detail by way of example with reference to the appended drawings in which.

Figure 1:
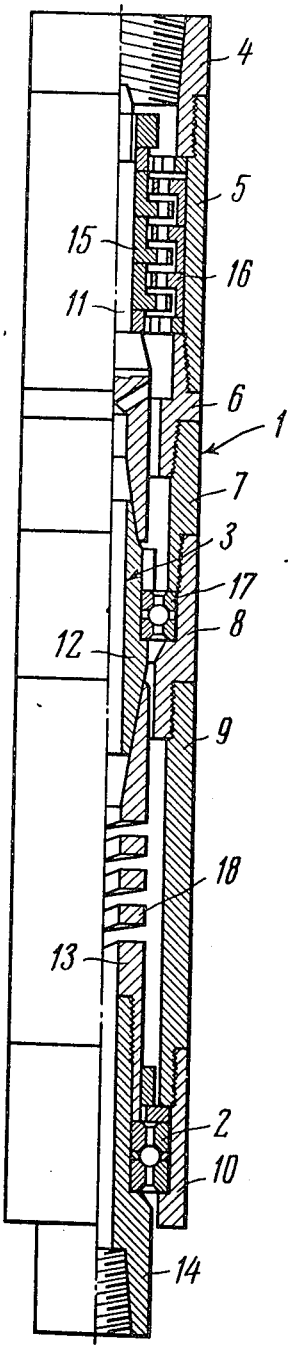
FIG. 1 shows a turbodrill wherein the flexible element is rigidly connected with the two adjacent sections of the built-up shaft and has the form of a coil spring working in compression and twisting.

The turbodrill according to the invention is comprised of a body 1 (FIG. 1) accommodating thrust bearing 2 which carries a shaft 3 taking the reaction of the bottom hole.

The turbodrill body 1 is of a sectional type. The sections 4,5,6,7,8,9 and 10 of the body 1 are connected with one another. The shaft 3 is built up of separate consecutively-connected sections 11,12,13 and 14.

Turbine rotors 15 are rigidly secured on the section 11 of the shaft 3 whereas turbine stators 16 are also rigidly secured on the section 5 of the body 1. Under the action of the drilling fluid flow and the pressure drop, the turbine rotors produce a torque and a hydraulic load is taken by the shaft 3. According to the invention, there is an additional thrust bearing 17 installed between the thrust bearing 2 and the turbine rotors 15 on the section 12 of the shaft 3, said additional bearing taking the hydraulic load of the shaft 3. Built in between the thrust bearings 2 and 17 on the section 13 of the shaft 3 is a mechanism which transmits torque from the section 12 to the section 14 of the shaft 3 and which is capable of elastic deformation. Owing to this deformation said mechanism relieves the additional thrust bearing 17 from hydraulic load and transmits the latter to the thrust bearing 2 which takes the reaction of the bottom hole.

The elastically-deformable mechanism is a flexible element one end of which is rigidly secured to the section 12 of the built-up shaft 3 while its other end is rigidly connected to the section 14 which carries the thrust bearing 2 taking the reaction of the bottom hole.

The flexible element illustrated in FIG. 1 is a coil spring 18 made integral with the section 13 of the shaft 3.

Figure 2:
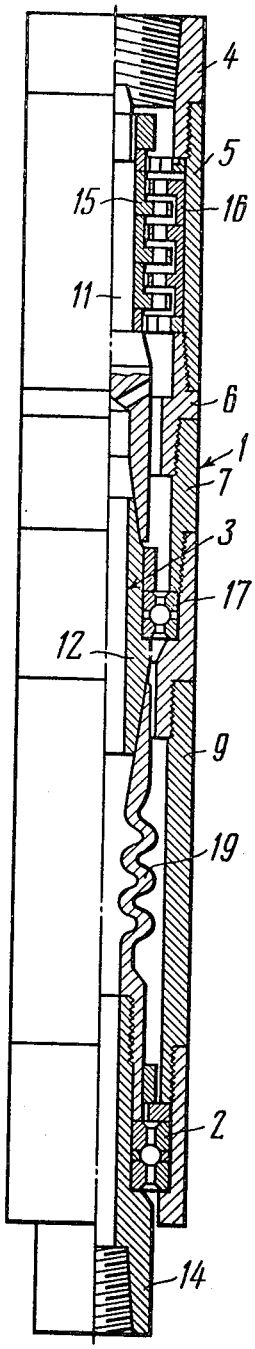
FIG. 2 shows a turbodrill wherein the flexible element is made in the form of a bellows working in twisting and compression and connected rigidly with the two adjacent sections of the built-up shaft.

FIG. 2 shows a flexible element in the form of a bellows 19.

Figure 3:
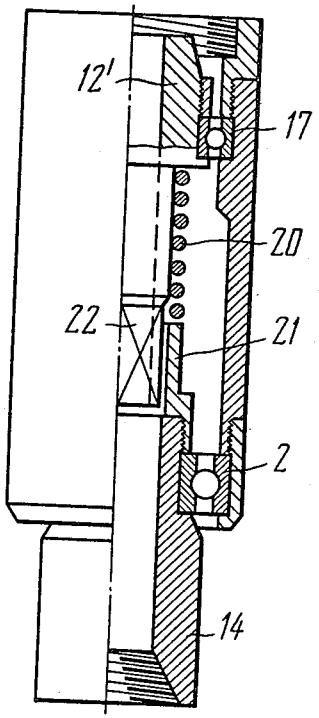
FIG. 3 shows a turbodrill spindle whose flexible mechanism has the form of a coil spring working in compression and there is a coupling between the two adjacent sections of the built-up shaft, said coupling allowing the shafts to move axially relative to each other and transmitting torque from the upper shaft section to the lower one.

To facilitate the work of the flexible element, FIG. 3 shows another version of the mechanism transmitting torque and hydraulic load from one shaft section to the other.

This mechanism comprises a spring 20 working in compression and a coupling consisting of two half-couplings 21 and 22. The spring 20 is installed between the section 12' which mounts the additional thrust bearing 17 and the section 14 of the shaft 3 which mounts the thrust bearing 2. One end of the spring 20 bears against the face of the section 12' of the shaft 3 whereas its other end bears against the face of the half-coupling 21. The half-couplings 21 and 22 are installed between the sections 12' and 14 of the shaft 3 with a provision for axial motion of one half-coupling relative to the other to make up for the play caused by the wear of the thrust bearings 2 and 17.

The half-couplings 21 and 22 when connected with each other are either square in cross section, of have any other shape which ensures the transmission of torque from one shaft section to the other.

Figure 5:
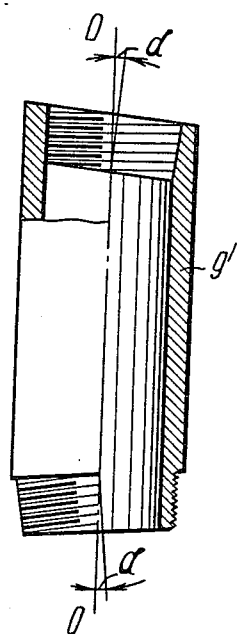
FIG. 5 shows a spindle body with slanted threads for use with a turbodrill when the bore hole has to be curved.
Figure 4:
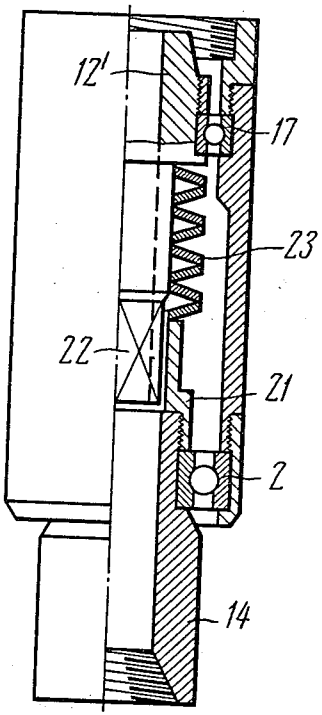
FIG. 4 shows a turbodrill spindle provided with a number of Belleville spring washers working in compression while a coupling installed between the two adjacent sections of the built-up shaft allows the shafts to move axially relative to each other and transmits torque from the upper shaft section to the lower one.

In the elastically-deformable mechanism shown in FIG. 4 the flexible element is made in the form of a multiple-row Belleville spring 23. Further, there is a vertion of the section 9 of the body 1 which is designated 9' in FIG. 5. If the thread axes on this section are slanted at an angle $\alpha$ to the axis 0 - 0 of the body, this creates a deflecting force on the bit (not shown in the drawing) which curves the bore hole in the required direction in the course of drilling.

The turbodrill according to the invention functions as follows.

The drilling fluid pumped by mud pumps enters the swivel, then the kelly, the drilling string and the turbodrill. The drilling fluid entering the turbine creates a torque on the turbodrill shaft 3.

The pressure drop in the turbine builds up a hydraulic load on the turbodrill shaft 3, said load being taken by the additional thrust bearing 17.

To relieve this thrust bearing, the flexible element 18,19, 20,23 is compressed so as to equalize its compressive force with the hydraulic load applied to the turbodrill shaft 3.

In this case the thrust bearing 17 will practically be relieved.

On the other hand, the compression force of the flexible element 18,19,20,23 will be transmitted to the thrust bearing 2 which takes the reaction of the bottom hole, thus relieving said bearing partly. Inasmuch as the thrust bearing 17 is practically relieved during operation, its races and ball elements are worn very slowly which extends considerably the turbodrill overhaul life. Wear of the thrust bearing 2 exerts no influence on the position of the turbine rotors 15 relative to the stators 16 and can, therefore, reach considerably greater values than it is permissible in the known turbodrills, thus increasing the turbodrill overhaul life.

What we claim is:

1. A turbodrill comprising: a body; a turbine having rotors for generating a torque and a hydraulic load, and stators; thrust bearing means taking the reaction of a bottom hole; a shaft installed in said body on said thrust bearing means and built up of a number of consecutively connected sections and carrying said rotors; additional thrust bearing means taking a hydraulic load, mounted on said shaft; means transmitting torque from one shaft section to another and capable of elastic deformation for relieving said additional thrust bearing means from hydraulic load and transmitting the latter to said thrust bearing means taking the reaction of the bottom hole.

2. A turbodrill according to claim 1 wherein the elastically-deformable means comprises a flexible element one end of which is connected rigidly with the section of the built-up shaft carrying the additional thrust bearing while its other end is rigidly connected with the section of the built-up shaft carrying the thrust bearing taking the reaction of the bottom hole.

3. A turbodrill according to claim 2 wherein the flexible element has the form of a coil spring.

4. A turbodrill according to claim 2 wherein the flexible element has the form of a bellows.

5. A turbodrill according to claim 1 wherein the elastically-deformable means comprises a compression spring installed between sections of the builtup shaft which carry the additional bearing and the bearing which takes the reaction of the bottom hole, and a coupling installed between said shaft sections with means for an axial motion to provide elastic compressive deformation of the spring, and transmitting torque from one of said shaft sections to the other.

* * * * *